US010994822B1

(12) United States Patent
Derginer et al.

(10) Patent No.: US 10,994,822 B1
(45) Date of Patent: May 4, 2021

(54) MARINE STEERING SYSTEM AND METHOD PROVIDING RESISTANCE CONTROL

(71) Applicant: Brunswick Corporation, Mettawa, IL (US)

(72) Inventors: Matthew Eric Derginer, Butte des Mort, WI (US); Mark Raymond Hanson, Oshkosh, WI (US); Peter Christian Schneider, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 55 days.

(21) Appl. No.: 16/516,843

(22) Filed: Jul. 19, 2019

(51) Int. Cl.
*B63H 25/42* (2006.01)
*B63H 25/02* (2006.01)

(52) U.S. Cl.
CPC ..... *B63H 25/42* (2013.01); *B63H 25/02* (2013.01); *B63H 2025/022* (2013.01)

(58) Field of Classification Search
CPC ... B63H 25/42; B63H 25/02; B63H 2025/022
See application file for complete search history.

(56) References Cited

U.S. PATENT DOCUMENTS 6,273,771 B1 * 8/2001 Buckley ..... B63H 21/213 114/144 RE
7,315,779 B1 * 1/2008 Rioux ..... B62J 27/00 123/352
7,380,538 B1 * 6/2008 Gagnon ..... B60K 31/04 123/403
7,530,345 B1 * 5/2009 Plante ..... B60K 31/00 123/361
7,727,036 B1 * 6/2010 Poorman ..... B63H 21/22 440/1
7,941,253 B1 * 5/2011 Brant ..... B63H 25/42 701/21
9,809,292 B1 * 11/2017 Gonring ..... B63H 25/02
9,908,606 B1 * 3/2018 Andrasko ..... B63H 25/02
9,994,296 B1 * 6/2018 Balogh ..... B63B 79/10
10,196,122 B1 * 2/2019 Andrasko ..... B63H 25/02
10,232,925 B1 * 3/2019 Gable ..... B63H 20/12
2002/0103589 A1 * 8/2002 Millsap ..... B62D 5/006 701/42

* cited by examiner

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A steering system on a marine vessel includes a steering wheel, a wheel sensor configured to measure wheel movement of the steering wheel, a steering actuator configured to rotate a steerable component based on movement of the steering wheel, and a variable resistance device controllable to apply a variable resistance amount to resist movement of the steering wheel. The system further comprises a controller that controls the variable resistance device and is configured to receive the wheel movement measurements by the wheel sensor and determine a resistance amount based on the wheel movement measurements and a corresponding steering response relative to the response capability of the steering system, and then to control the variable resistance device based on the resistance amount.

20 Claims, 6 Drawing Sheets

MARINE STEERING SYSTEM AND METHOD PROVIDING RESISTANCE CONTROL

FIELD

The present disclosure generally relates to steering systems on marine vessels, and more specifically to methods and systems for providing steering feedback on drive-by-wire steering systems on a marine vessel.

BACKGROUND

U.S. Pat. No. 6,273,771, incorporated by reference herein in its entirety, discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,727,036, incorporated by reference herein in its entirety, discloses a system and method for controlling movement of a marine vessel. An operator controllable device outputs a signal that is representative of an operator-desired rate of position change of the vessel about or along an axis. A sensor outputs a signal that is representative of a sensed actual rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

U.S. Pat. No. 7,941,253, incorporated by reference herein in its entirety, discloses a marine propulsion drive-by-wire control system that controls multiple marine engines, each one having one or more PCMs, i.e. propulsion controller, for controlling engine functions which may include steering or vessel vectoring. A helm has multiple ECUs, electronic control units, for controlling the multiple marine engines. A CAN, controller area network, bus connects the ECUs and PCMs with multiple PCM and ECU buses. The ECU buses are connected through respective isolation circuits isolating the respective ECU bus from spurious signals in another ECU bus.

U.S. Pat. No. 9,908,606, incorporated by reference herein in its entirety, discloses a drive-by-wire control system for steering a propulsion device on a marine vessel that includes a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

U.S. Pat. No. 10,196,122, incorporated by reference herein in its entirety, discloses a steering system on a marine vessel including a steering wheel movable by a vessel operator to steer the marine vessel and a variable resistance device controllable to apply a variable resistance amount to resist movement of the steering wheel. The system includes a control unit that controls the variable resistance device to determine a baseline resistance amount based on vessel speed and/or engine RPM and detect at least a threshold change in angular position of the marine vessel. The control unit then controls the variable resistance device to prevent a decrease in the resistance amount below the baseline resistance amount or to increase the resistance amount above the baseline resistance amount.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a steering system on a marine vessel includes a steering wheel, a wheel sensor configured to measure wheel movement of the steering wheel, a steering actuator configured to rotate a steerable component based on movement of the steering wheel, and a variable resistance device controllable to apply a variable resistance amount to resist movement of the steering wheel. The system further comprises a controller that controls the variable resistance device and is configured to receive the wheel movement measurements by the wheel sensor and determine a resistance amount based on the wheel movement measurements and a corresponding steering response relative to the response capability of the steering system, and then to control the variable resistance device based on the resistance amount.

In one embodiment, a method of controlling a steering system on a marine vessel is provided. The steering system includes a steering wheel movable by a vessel operator to control a steering actuator that rotates a steerable component, and a variable resistance device controllable to apply a variable resistance amount to resist movement of the steering wheel by the vessel operator. The control method includes receiving wheel movement measurements from a sensor associated with the steering wheel, and then determining a resistance amount based on the wheel movement measurements and a corresponding steering response relative to a response capability of the steering system. The variable resistance device is then controlled based on the resistance amount. For example, a maximum resistance amount may be applied when the wheel movement measurements correspond to a maximum response capability of the steering system.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
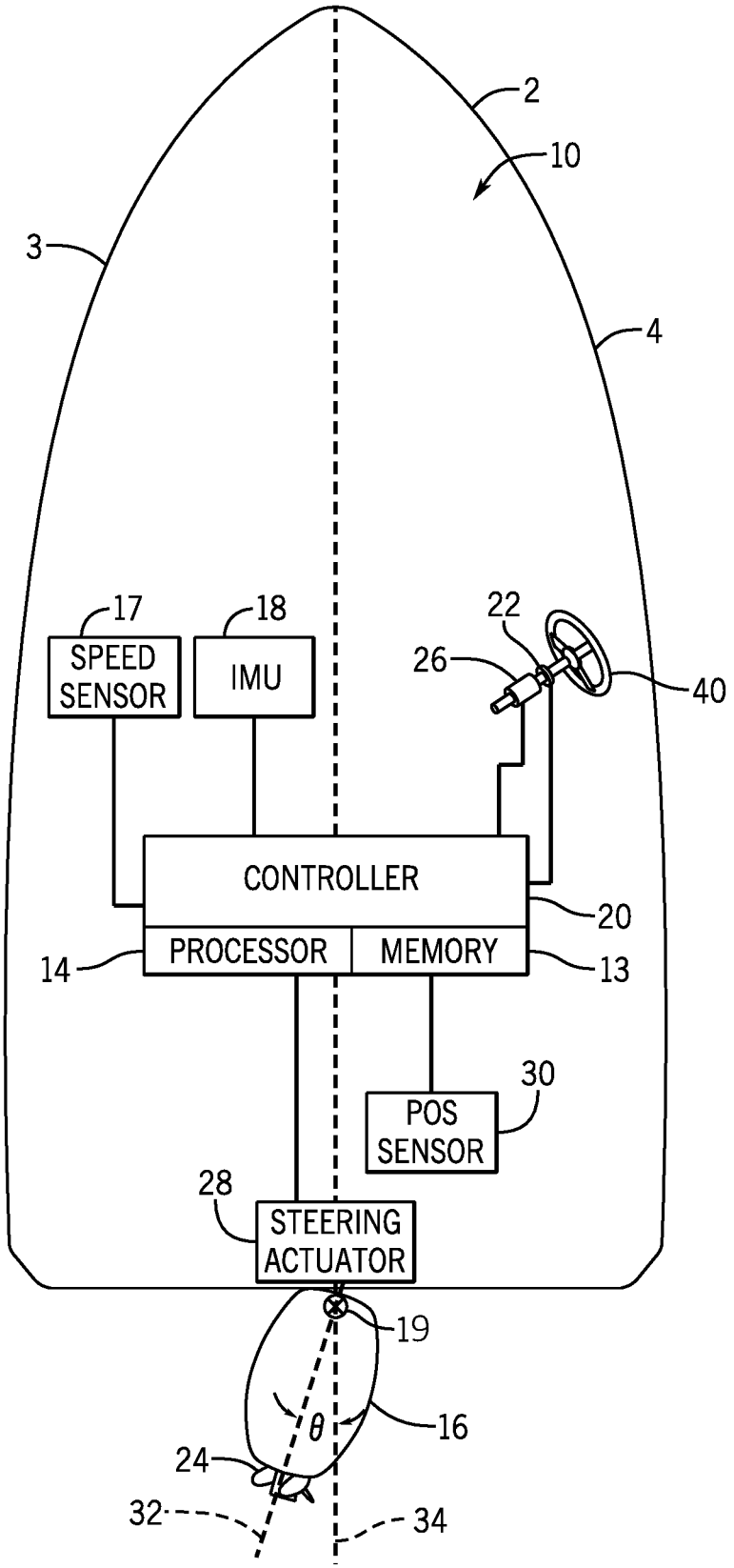
FIG. 1 is a schematic diagram of one embodiment of the steering system on a marine vessel according to the present disclosure.

Conventional mechanical and/or hydraulic steering systems for marine vessels advantageously provide direct tactile feedback to a user regarding operating conditions experienced by the propulsion device. The tactile feedback is transmitted via hydraulic and/or mechanical linkages between the user input device, the steering system, and the propulsion device(s). The present inventors have recognized that vessel operators rely on this tactile feedback instead of their own visual perception of the vessel's heading to gauge appropriate steering input, and that operators expect this sort of feedback, or "feel," on all marine steering systems.

In steer-by-wire systems, the user input device (such as the steering wheel) and steering actuator(s) electronically communicate and are not connected by hydraulic or mechanical linkages. Thus, they do not provide mechanical feedback to drivers. The present inventors have recognized that current drive-by-wire steering systems are insufficient and do not provide tactile feedback that enables the user to intuitively understand and account for the conditions experienced by the steering system on the marine vessel. The present inventors have also recognized that providing insufficient or inaccurate feedback on a steering input device, such as a steering wheel, is disadvantageous and can cause a user to unintentionally overcorrect or undercorrect steering input due to an inability to judge the heading change associated with a particular steering input. Further, the present inventors have recognized that users are dissatisfied with currently available drive-by-wire steering systems because the feedback provided is unsatisfactory, as it does not consistently or accurately correlate with what the marine vessel is doing or with the conditions experienced by the propulsion device The inaccuracy of the feedback mechanisms and control on such currently-available drive-by-wire systems yields a numb or disconnected steering feeling for the user, which has been a long-standing problem of steer-by-wire systems. For example, the present inventors have recognized that drive-by-wire systems that provide steering feedback based on speed, such as vessel speed, are insufficient because vessel speed does not account for all conditions of the boat where steering feedback is desired or expected by a user. In general, such speed-based drive-by-wire steering control systems provide less steering resistance at slower speeds, and more steering resistance at higher speeds. Thus, steering at slower speeds requires less effort from the user than steering at high speeds.

The inventors have recognized that speed-based control is insufficient for creating a steer-by-wire system with desirable handling characteristics because force feedback on the steering wheel does not account for the response capability of the steering system on the marine vessel. For example, current steer-by-wire systems allow the steering wheel to be turned faster than the actual response capabilities of the steering actuator on the marine vessel, and well beyond the responsive turn rate of the marine vessel as well. Accordingly, drivers perceive a lag between the steering input and the steering response of the system. Accordingly, the inventors have recognized that the steering resistance feedback, or "force feel profile" of the steering wheel, should be matched to either the actual response time of the steering actuation system, or the actual steering response time of the marine vessel.

As provided in the present disclosure, the inventors developed a system where the resistance applied to the steering wheel is based on a steering response of the steering actuator or marine vessel relative to a response capability of the steering system. In one embodiment, a profile is set up in the frequency domain such that the resistance amount applied to the steering wheel is proportional to the responsiveness of the steering system or the turn rate of the marine vessel at the given combination of amplitude and frequency of steering input. The profile is set up such that when the steering input reaches the maximum response capability of the system—i.e., the point at which the steering commands are sufficiently out of phase with the response—the wheel becomes very difficult to turn. This cues the operator to the limitations of the steering system on a marine vessel and provides a more natural and intuitive steering control experience.

FIG. 1 illustrates a marine vessel 2 having a port side 3 and a starboard side 4. A steerable component 16 is located on the marine vessel 2 and positioned to effectuate a force thereon to control the direction of motion of the vessel, such as a propeller 24 imparting a thrust near a stern of the marine vessel 2. In the example shown, the steerable component 16 is coupled to, or able to be coupled into, the steering system 10 of the marine vessel 2. The steerable component 16 may comprise any of a pod drive, an outboard motor, a stern drive, or a jet drive. Thus, the steerable component 16 may be coupled in torque transmitting relationship with an internal combustion engine via an output shaft. In a stern drive embodiment, for example, the steerable component 16 may include a propeller shaft that connects to a propeller 24. Alternatively, in an outboard embodiment, the steerable component may include the entire outboard, which is rotated about a vertical steering axis 19. When torque is transmitted from the internal combustion engine to the propeller shaft and the propeller 24, a thrust is produced to propel the marine vessel 2 in a direction that corresponds to a steering position of the steerable component 16. Alternatively, if the marine vessel 2 is provided with an inboard drive, the steerable component 16 may be a rudder.

In the example of FIGS. 1 and 3, the steerable component 16 is steerable around a vertical steering axis 19, it being understood that different types of marine vessels and steerable components may have steering axes that are not vertically aligned. The rotation about steering axis 19 is actuated by a steering actuator 28, which actuates the steerable component 16 to one of a plurality of positions so as to control direction of movement of the marine vessel 2. The steering actuator 28 may be, for example, any hydraulic, electric, or electric over hydraulic steering actuator. For example, the steering actuator 28 may be a hydraulic pump that pumps pressurized hydraulic fluid through a control valve to either side of a piston-cylinder, as is common and known in the relevant art, to control movement of the steerable components 16. A position sensor 30 is located on or associated with the steering actuator 28 or the steerable component 16 to sense a steering position or steering angle of the steerable component 16, referred to herein as the component position. The component position may be, for example, a distance or an angle between a center axis 32 of the steerable component 16 from the centerline 34 of the marine vessel 2 (or a line parallel thereto, if the steering system 10 includes multiple propulsion devices), which is depicted as angle θ in FIG. 1. A rotation rate of the steerable component may be determined as a change in the component position over time, or as a change in a sensed position of the steering actuator 28 over time.

This type of digitally-controlled steering arrangement is commonly referred to in the art as a "steer-by-wire" system, wherein there is no direct mechanical connection between the steering wheel 40 and the steering actuator 28 or the steerable component 16, but such control is provided by one or more controller 20 receiving inputs from the various components in the steering system 10 and controlling the steering actuator 28 accordingly. For example, such communication between the various components within the system 10 may be provided on a communication bus, such as on a controller area network (CAN) bus. In other embodiments, however, any type of wired or wireless communication may be provided between the various devices. In the embodiment depicted in FIG. 1, the communication link lines are meant only to demonstrate that the various elements are capable of communicating to or between one another and do not represent actual wiring connections between the various elements, nor do they represent the only paths of communication between the elements.

In one embodiment, a certain rotation of the steering wheel 40 gets related to an amount of rotation of the steerable component 16, and such relation is generally provided by one or more drive angle maps stored in memory of one or more controller within the steering system 10. In certain embodiments, the relation between the angle of the steering wheel 40 and the angle of the steerable component 16 may vary for a particular marine vessel depending on vessel conditions, such as vessel speed, engine speed, engine load, or the like. Each of the one or more drive angle maps may associate a sensed position of the steering wheel 40 with a particular position of the steerable component 16, which may also be a particular position of the steering actuator 28. For example, the position of the steering wheel 40 may be sensed by a wheel position sensor 22 associated with the steering wheel, which may be, for example, an encoder or transducer or another type of position sensor, many of which are conventional for such applications. In other embodiments, the position of the steerable component may be correlated with a normalized steering value. In certain embodiments, the steering wheel position is normalized, such as to a scale between −100% and 100%, and the movement of the steerable component 16 is correlated to that normalized steering value. This allows for flexible steering implementation, where the range of possible component position angles can be adjusted independently of the correlation with sensed positions of the steering wheel 40. For example, the steering system 10 may be configured to provide a wider range of component positions (e.g. drive angles of an outboard motor) at lower vessel speeds, and then restrict the possible range of component positions as the vessel speed increases.

One or more controllers 20 within the steering system 10 are configured to receive the steering wheel position measurement from the wheel position sensor 22 and to determine a corresponding component position for the steerable component 16 based thereon. Additionally, the component position may be based on other inputs from elements within the system 10. For example, the controller may receive a vessel speed from a speed sensor 17 that measures speed of travel of the marine vessel 2, and may further correlate the wheel position to the component position based thereon. The speed sensor 17 may be any device capable of measuring or determining the speed of the marine vessel 2, and in exemplary embodiments may include a pitot tube, a paddle wheel, or a global positioning system (GPS)-based speed determination system. Alternatively or additionally, the relation between the steering input provided at the steering wheel 40 and the steering position of the steerable component 16 may further be controlled based on engine speed or engine load of an engine within one or more propulsion device(s) of the marine vessel 2. The steering system 10 may further include or receive input from a vessel position sensor, such as an inertial measurement output from an IMU 18 indicating linear and angular motion of the marine vessel 2. For example, the IMU 18 may include one or more of a three-axis gyroscope, a three-axis accelerometer, and a magnetic compass, or a three-axis magnetometer. In such an embodiment, an inertial measurement output of the IMU indicates a pitch, roll, and yaw of the marine vessel and/or a change in pitch, roll, and/or yaw of the marine vessel 2. In other embodiments, the IMU 18 may be configured to sense position and/or movement in only one or two axes, such as yaw and roll of the marine vessel.

The steering system 10 includes one or more controllers that provide the control function and methods described herein for controlling position of the steerable component 16 based on inputs provided at the steering wheel 40—i.e., based on rotational movement of the steering wheel. In the depicted embodiment, a central controller 20 receives inputs regarding wheel position of the steering wheel 40 from the wheel position sensor 22 and receives inputs regarding the component position of the steerable component 16 from position sensor 30. In the depicted embodiment, the controller 20 also receives input from speed sensor 17 and IMU 18.

The controller 20 then controls steering of the steerable component 16 by sending control signals to the steering actuator 28 causing it to move the steerable component 16 to the desired steering position. In various embodiments, the steering system 10 may include one or more controllers that perform various aspects of the disclosed method. For example, the steering control logic may be split between a helm controller providing central control of various aspects of the marine vessel, and other controllers, such as a CAN-based control module associated with the steering wheel 40 and resistance device 26. Thus, although the controller 20 is represented in the depicted embodiment as a single control device including memory 13 and a programmable processor 14, the controller 20 may actually be embodied as multiple different controllers. For instance, the steering system 10 may incorporate a central controller, such as a helm control module, and a CAN-based steering wheel control module communicatively connected to the central control module, wherein both modules cooperate to provide the control functions described herein. In other embodiments, some or all of the control functions described herein may be performed by one or more CAN-based or other controllers associated with the steering wheel 40 and/or the steering actuator 28, with no input from a central control module, such as a helm control module.

The systems and methods described herein may be implemented with one or more computer programs executed by one or more processors, which may all operate as part of a single controller 20 or as separate controllers as described above. The computer programs include processor-executable instructions that are stored on a non-transitory tangible computer-readable medium. The computer programs may also include stored data.

The variable resistance device 26 enacts a resistance to resist rotational movement of the steering wheel 40, such as imparting a resistance on the steering shaft of the steering wheel 40. The variable resistance device 26 may include any of various types of electrical, mechanical and/or hydraulic devices controllable to variably resist (e.g., restrict and/or brake) rotational movement of the steering wheel 40. Exemplary variable resistance devices 26 include any one or more of a magnetorheological (MR) device, an electric brake (such as but not limited to an electromagnetic or mechanical contact brake), an electromagnet hysteresis brake, a permanent magnet hysteresis brake, a direct-connected servo or stepper motor, a hydraulic cylinder, a linear actuator, a mechanical friction slip clutch, or the like. To provide just one specific exemplary arrangement, the variable resistance device 26 may include an electric motor or a hydraulic pump that powers a mechanical clamp or other similar device that directly or indirectly engages the steering shaft to resist its rotational movement, either in the clockwise, counterclockwise, or both rotational directions. In an alternative embodiment, the variable resistance device 26 is an MR fluid braking mechanism attached to the steering shaft and applying a variable resistance force thereon in response to a varying magnetic field.

The variable resistance device 26 is controlled by the controller 20 to effectuate appropriate steering feedback in order to account for a response capability of the steering system 10 to steer the marine vessel 2 in response to a turn input by an operator at the steering wheel 40. The response capability may be, for example, based on a frequency response of the steering actuator 28 within the steering system 10 or based on a frequency response of the vessel turn or roll to steering input. Alternatively or additionally, the response capability of the steering system 10 may be based on a rotation rate at which the steering actuator 28 can rotate the steerable component 16—e.g., using a known actuation response profile for the steering system 10. If the actuation response profile is not known, a frequency response test can be run to determine a response capability of the steering system 10 based on a range of steering input frequencies. For example, a "chirp" signal of increasing frequency can be injected into the steering axis, or steering control input (e.g. normally dedicated to the wheel sensor 22), and measure the appropriate response. For instance, the measured response may be a rotation rate at which the steering actuator rotates the steerable component, which is a rate of change of the steering angle. In another embodiment, the detected response of the steering system may be a turn rate or roll rate of the marine vessel, such as measured by the IMU 18.

Figure 2:
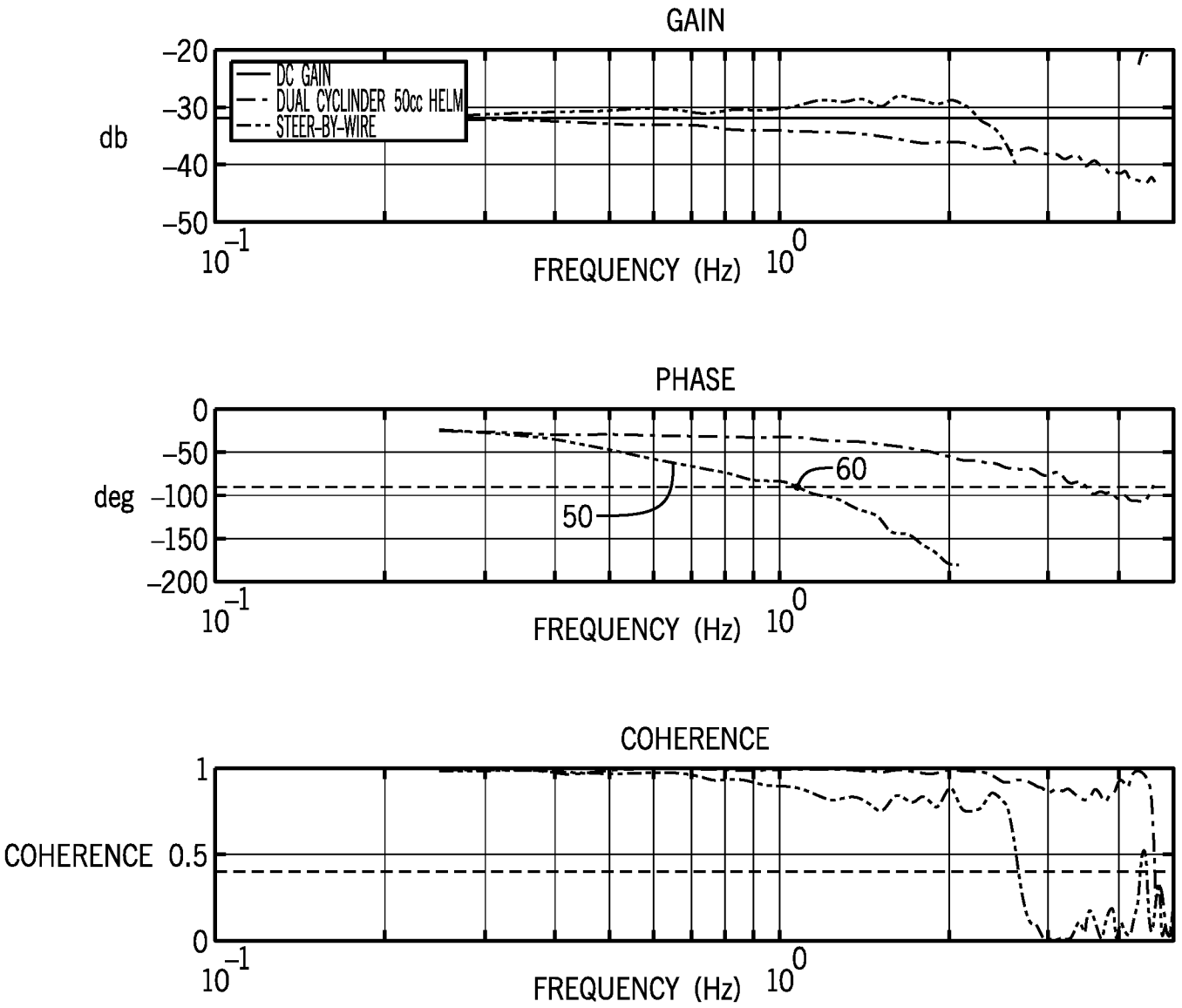
FIG. 2 depicts graphs showing a frequency response of an exemplary steer-by-wire system compared to a conventional hydraulic steering system.

Frequency response may be represented as the resultant gain and phase between the input chirp and the measured output response. The graph at FIG. 2 shows exemplary steering actuation response resulting from a frequency response test utilizing a chirp input. FIG. 2 shows a Bode plot demonstrating the gain and phase of a steering actuator 28 to an input chirp providing an input that increases in frequency over time. The plots show a frequency response test result for a hydraulic power steering system, particularly a dual cylinder 50 cc power steering system, compared to an exemplary steer-by-wire system. As shown in the plots, the bandwidth of the steer-by-wire system is narrower than that of the hydraulic system, which is typical. Thus, the "detached" and "lagging" feel of the steering system will be more prevalent at high turn rates with the steer-by-wire system than the hydraulic system.

The system and method disclosed herein alleviate that detached and lagging feel by applying a feedback resistance amount on the steering wheel proportional to the taxation of the steering system 10—i.e., the steering response demanded by the input at the steering wheel relative to the response capability of the steering system. Thereby, the force received by the operator turning the steering wheel 40 is proportional to the increase in frequency. Since the hydraulic system naturally provides this type of steering feedback, the hydraulic system limits itself to an acceptable operating range where the delay between the input and the desired response in the system is minimized so as to be imperceptible by the operator. The inventors have recognized that such feedback can be mimicked by mapping feedback resistance, and thus force feel, to the frequency response. Namely, the variable resistance device is controlled to increase the resistance amount based on the frequency of the steering input at the wheel 40. Where the steering input reaches the response capability of the steering system 10, the variable resistance device is controlled to apply a maximum resistance. Thereby, the user will not be able to turn the steering wheel faster than the response capability of the system.

In one embodiment, the phase curve 50 of the frequency response can be utilized to determine the appropriate resistance amount. In one embodiment, the resistance amount supplied by the variable resistance device 26 will be maximized at the point 60 where the phase curve 50 crosses 90 degrees. This is the point where the steering input matches the response capability of the steering system 10, and thus represents the fastest steering wheel movement that can be achieved by the system 10 without lag.

Figure 4:
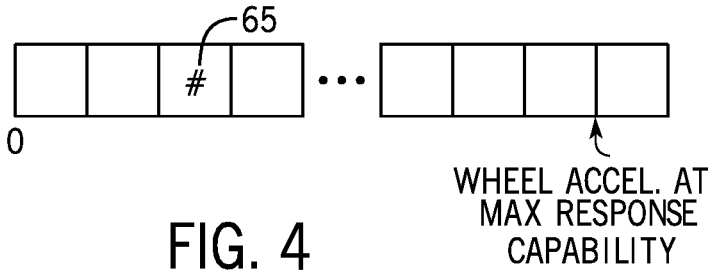
FIG. 4 depicts an exemplary map correlating real acceleration with a feedback resistance amount applied to the steering wheel.

In one embodiment, the phase curve 50 of the frequency response may be utilized to generate a map that corresponds steering wheel input, or movement of the steering wheel, to resistance amount values, where such a map can then be utilized to control the variable resistance device 26 based on steering wheel inputs. FIG. 4 schematically represents such a map, which is a lookup table providing resistance amount values 65 based on movement of the steering wheel 40. In the depicted example at FIG. 4, the lookup table is determined based on wheel acceleration, and maps a range of wheel acceleration values between zero and a maximum acceleration that matches the response capability of the system to a resistance amount value 65. In other embodiments, the map may be generated based on wheel velocity, and thus may provide resistance amount values based on wheel velocity between zero and the wheel velocity that matches the maximum response capability of the system 10.

In one embodiment, the map may be generated using the results of the phase curve of the frequency response and an associated peak velocity or acceleration computed at various combinations of input amplitude and frequency. Measured velocity or acceleration of the wheel, such as based on output of the wheel sensor 22, is then used to look up a correct resistance amount setting in real-time, which is proportional to the phase measurements taken during calibration. Such a map correlating wheel acceleration or velocity to resistance amount is generated by using a corresponding one of the following equations, where a given amplitude at a certain frequency results in a peak acceleration or velocity, where A is the amplitude of the input excitation and f is the frequency:

$$\text{Velocity}=\pi f A\cos(2\pi f t)$$

$$\text{Accel}=-2\pi^2 f^2 A\sin(2\pi f t)$$

The map is thus generated such that the resistance amount provided at an acceleration or velocity analogous to the response capability, or bandwidth point, of the system is high enough to prevent the operator from turning the wheel faster than the system can respond, or at least high enough such that the operator would be clued in to the limitation of the steering system 10 on the marine vessel. In this way, each steering system 10 is individually tailored to communicate its response capability, or bandwidth limitations, back to the operator. In turn, this prevents the operator from perceiving that the system provides an unsatisfactory lag.

Figure 3A:
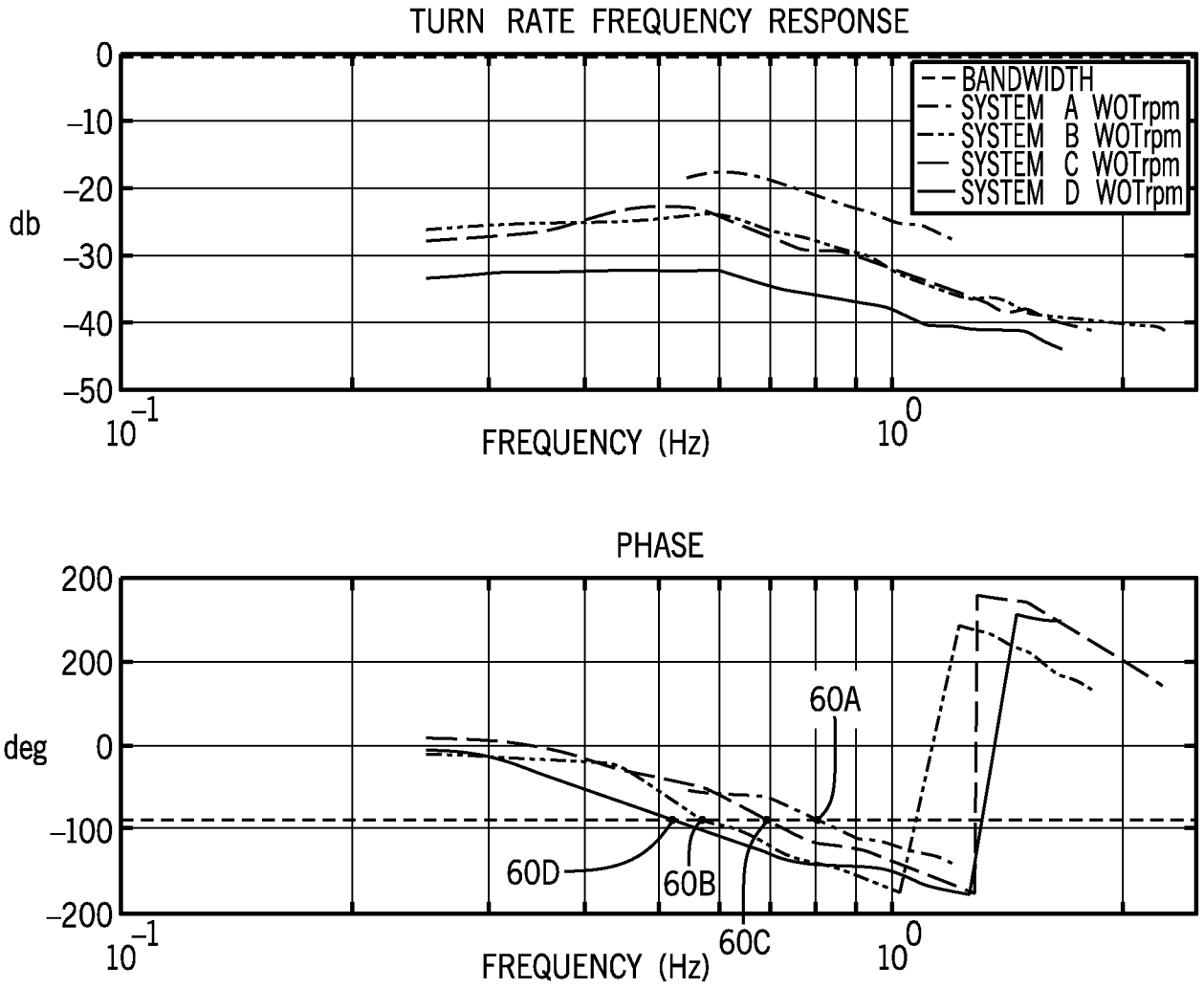
FIGS. 3A and 3B are graphs showing frequency response of a turn for a marine vessel.
Figure 3B:
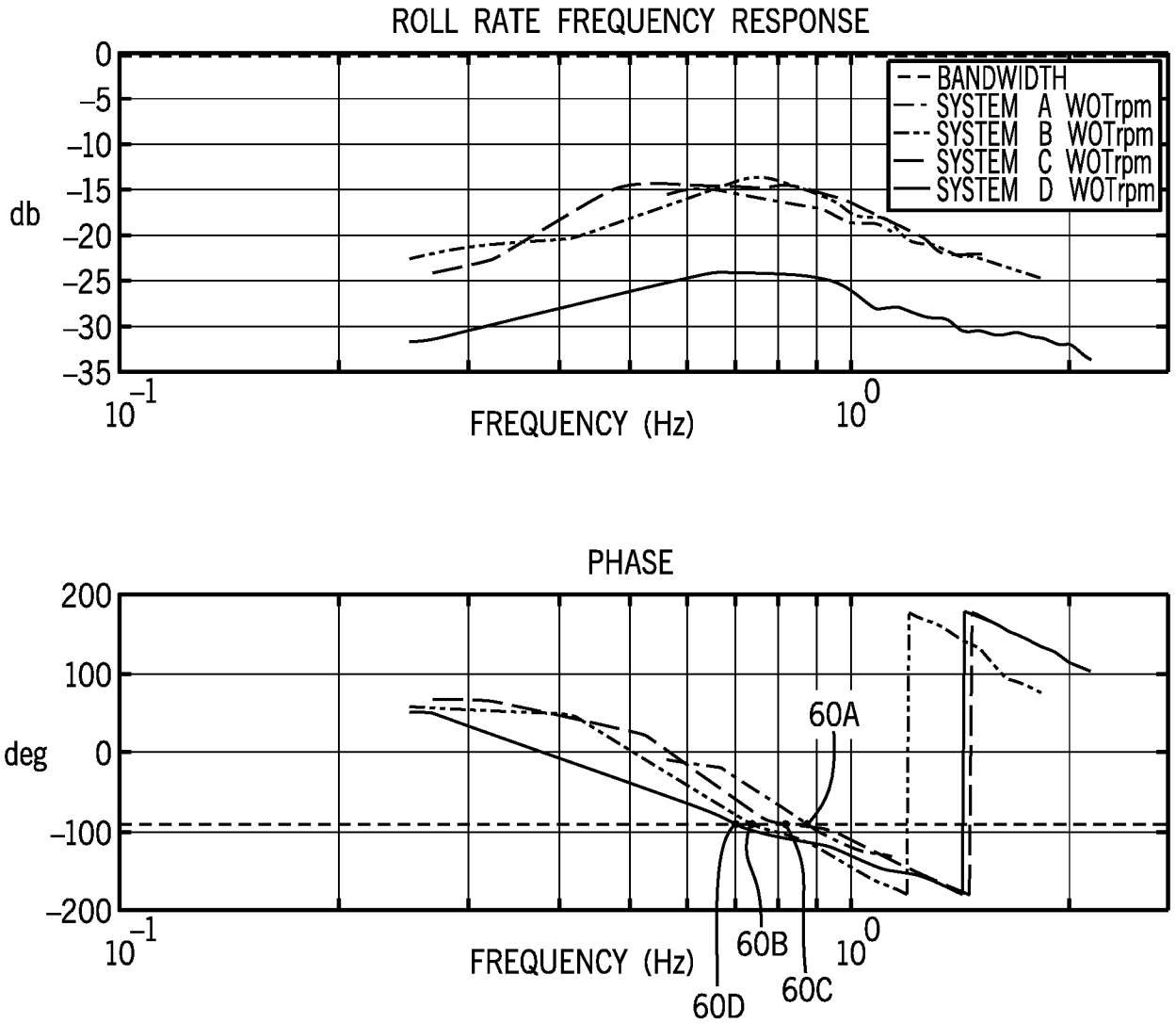

The graphs at FIG. 2 depict frequency response of the steering actuator 28 operating within a particular steering system 10. In other embodiments, turn response of the marine vessel, itself, can be utilized. FIGS. 3A and 3B each depict alternative embodiments for measuring frequency response, with FIG. 3A demonstrating Bode plots showing the frequency response of the turn rate of multiple different marine vessels and/or different steering systems resulting from the above-described chirp input, and FIG. 3B depicting frequency response of roll rate of the different marine vessels and/or steering systems based on the above-described chirp input. For example, the turn rate and roll rate measurements may be based on output of respective IMUs 18 on each vessel. A map may similarly be generated as described above utilizing the results of the phase curve for each respective system. The map is generated correlating wheel movement, such as wheel velocity or wheel acceleration, to the resistance amount based on the phase curve such that the resistance amount is maximized at points 60*a*-60*d*, respectively, where the phase curve reaches 90 degrees. Thus, where the phase is closer to zero, a low resistance amount is applied such that the operator feels minimal steering resistance. As the acceleration increases, correlating to a higher phase, the mapped resistance amount increases such that the correlated resistance amount is maximized at the point where the phase reaches 90 degrees in order to prevent the operator from turning the wheel faster than the turn capability of the marine vessel. As described above, the map may correlate either wheel acceleration or wheel velocity to the phase curve of the vessel turn rate or roll rate frequency response.

Figure 5:
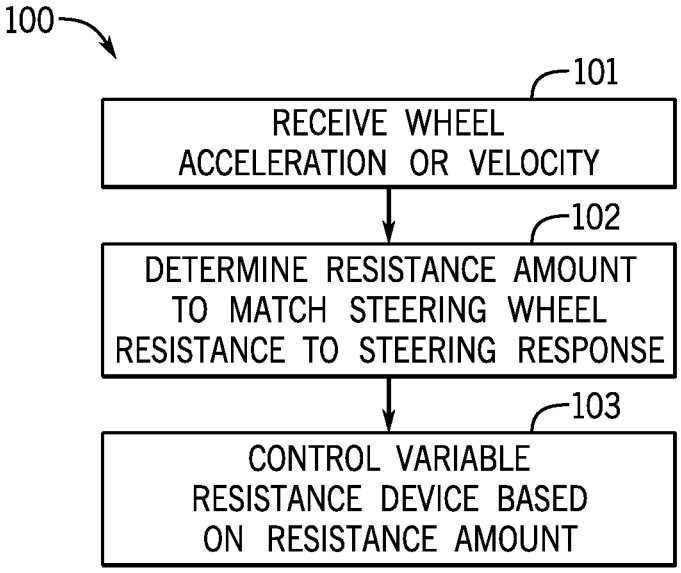
FIG. 5 depicts one embodiment of a method, or portion thereof, for controlling a steering system according to an exemplary embodiment of the present disclosure.

FIG. 5 is a flow chart demonstrating one embodiment of a method 100 of controlling a steering system 10 on a marine vessel in order to provide feedback resistance that matches the response capability of the steering on a particular marine vessel. A wheel movement measurement, and particularly wheel acceleration or wheel velocity, is received at step 101. A resistance amount is then determined at step 102 to match the steering wheel resistance to the steering response relative to a response capability of the steering system 10, such as the response capability of the steering actuator 28 or the turn rate capability of the marine vessel 2 and steering system 10 as a whole. The variable resistance device 26 is then controlled at step 103 to exert the resistance amount as appropriate to provide steering feedback that corresponds to the relative steering response.

The resistance amount may be determined by accessing a map that correlates resistance amount to wheel velocity or acceleration, where the resistance amount entries are determined using either the known phase curve of the frequency response, or the closed-loop transfer function of the system 10 design. Where the map is generated based on the phase curve, an automated test procedure may be conducted to measure the frequency response of the steering actuator 28 or the steering system 10 and marine vessel 2 as a whole.

Figure 6:
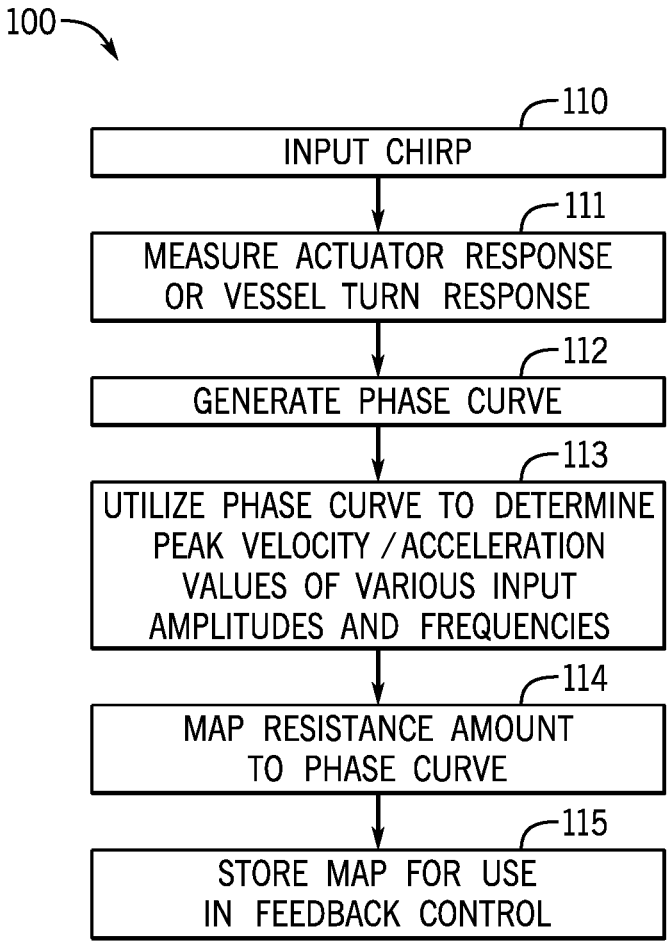
FIG. 6 depicts another embodiment of a method, or portion thereof, for controlling a steering system according to an exemplary embodiment of the present disclosure.

FIG. 6 depicts one embodiment of method 100 including steps for generating a map based on a phase curve resulting from a frequency response test. A chirp signal is inputted at step 110, wherein the chirp presents an increasing frequency spanning at least the bandwidth of the steering system 10. The system response is measured at step 111, which may be the response of the steering actuator 28 turning the steerable component 16 or may be the turn response of the marine vessel 2. The phase curve is generated at step 112 presenting the phase shift resulting from the frequency characteristics of the chirp input. The phase curve is then utilized at step 113 to compute peak velocity or acceleration values at various amplitudes and frequencies. Resistance amounts are mapped to the phase curve at step 114. For example, zero degrees phase may be mapped to a minimum resistance amount, or baseline resistance force, and 90 degrees phase may be mapped to a maximum resistance amount applied by the variable resistance device 26. The resulting map correlates the various peak velocity or accelerations to a corresponding resistance amount. The map is then stored at step 115, such as in memory 13 of the controller 20, for use in controlling feedback on the steering wheel 40 based on the respective velocity or acceleration measurements by the wheel sensor 22.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A steering system on a marine vessel, the steering system comprising:

a steering wheel movable by a vessel operator to steer the marine vessel;

a wheel sensor configured to measure wheel movement of the steering wheel;

a steering actuator configured to rotate a steerable component based on the wheel movement of the steering wheel;

a variable resistance device controllable to apply a variable resistance amount to resist movement of the steering wheel;

a controller configured to:

receive the wheel movement measurements by the wheel sensor;

determine a resistance amount based on the wheel movement measurements and a corresponding steering response relative to a response capability of the steering system; and control the variable resistance device based on the resistance amount.

2. The system of claim 1, wherein response capability is based on a frequency response of the steering actuator to movement of the steering wheel.

3. The system of claim 1, wherein the response capability is based on a rotation rate at which the steering actuator can rotate the steerable component in the steering system.

4. The system of claim 1, wherein the response capability is based on a turn rate of the marine vessel in response to movement of the steering wheel.

5. The system of claim 1, wherein the wheel movement measurements are an acceleration of the steering wheel, and wherein the resistance amount increases as the acceleration of the steering wheel increases.

6. The system of claim 5, wherein the response capability of the steering system is a maximum rotation rate at which the steering actuator can rotate the steerable component, wherein the variable resistance device is controlled to apply a maximum resistance amount when the acceleration of the steering wheel corresponds to the maximum rotation rate of the steering actuator so as to prevent the operator from moving the steering wheel faster than the response capability of the steering actuator.

7. The system of claim 5, further comprising a map correlating acceleration of the steering wheel to resistance amount, wherein the controller is configured to determine the resistance amount based on the map.

8. The system of claim 7, wherein the map is based on a phase curve of a frequency response of the steering actuator as a function of acceleration.

9. The system of claim 1, wherein the wheel movement measurements include a velocity of the steering wheel, and wherein the resistance amount increases as the velocity of the steering wheel increases.

10. The system of claim 9, further comprising a map correlating velocity of the steering wheel to resistance amount, wherein the controller is configured to determine the resistance amount based on the map.

11. The system of claim 9, wherein the response capability of the steering system is a maximum rotation rate at which the steering actuator can rotate the steerable component, wherein the variable resistance device is controlled to apply a maximum resistance amount when the velocity of the steering wheel corresponds to a maximum rotation rate of the steering actuator so as to prevent the operator from moving the steering wheel faster than the maximum rotation rate of the steering actuator.

12. The system of claim 1, wherein the steering response is a turn rate of the marine vessel measured by a vessel position sensor and the response capability of the steering system is a maximum turn rate of the marine vessel.

13. The system of claim 12, wherein the variable resistance device is controlled to apply a maximum resistance amount when one of an acceleration and a velocity of the steering wheel corresponds to a maximum turn rate of the marine vessel so as to prevent the operator from moving the steering wheel faster than the maximum turn rate of the marine vessel.

14. A method of controlling a steering system on a marine vessel, the steering system comprising a steering wheel movable by a vessel operator to control a steering actuator that rotates a steerable component, and a variable resistance device controllable to apply a variable resistance amount to resist movement of the steering wheel by the vessel operator, the method comprising:

receiving wheel movement measurements of the steering wheel from a sensor associated with the steering wheel;

determining a resistance amount based on the wheel movement measurements and a corresponding steering response relative to a response capability of the steering system; and controlling the variable resistance device based on the resistance amount.

15. The method of claim 14, wherein the response capability of the steering system is based on a maximum rotation rate at which the steering actuator can rotate the steerable component, further comprising applying a maximum resistance amount when the wheel movement measurements correspond to the maximum rotation rate of the steering actuator.

16. The method of claim 14, wherein the wheel movement measurements are one of wheel acceleration and wheel velocity of the steering wheel.

17. The method of claim 16, wherein the wheel movement measurements are wheel acceleration and further comprising:

determining a phase curve of a frequency response of the steering actuator operating in the steering system as a function of acceleration of the steering wheel;

mapping resistance amount to the phase curve such that 0° phase is a minimum resistance amount and 90° phase is a maximum resistance amount;

utilizing the map for determining the resistance amount based on the wheel acceleration.

18. The method of claim 17, further comprising determining the frequency response of the steering actuator operating in the steering system by injecting a chirp signal as steering input and measuring a rate at which the steering actuator rotates the steerable component.

19. The method of claim 16, further comprising:

determining a phase curve of a frequency response of a turn rate of the marine vessel as a function of wheel acceleration or wheel velocity of the steering wheel;

mapping resistance amount to the phase curve such that 0° phase is a minimum resistance amount and 90° phase is a maximum resistance amount;

utilizing the map for determining the resistance amount based on the wheel acceleration or wheel velocity.

20. The method of claim 19, further comprising determining the frequency response of the turn rate of the marine vessel by injecting a chirp signal as steering input and measuring a rate at which the marine vessel turns.

* * * * *